US006191372B1

(12) United States Patent
Sasaki et al.

(10) Patent No.: US 6,191,372 B1
(45) Date of Patent: Feb. 20, 2001

(54) SWITCH DEVICE CAPABLE OF MAINTAINING STABLE KNOB OPERABILITY OVER LONG TERM

(75) Inventors: Mikio Sasaki; Kazuo Sotooka, both of Miyagi-ken (JP)

(73) Assignee: Alps Electric Co., Ltd., Tokyo (JP)

( * ) Notice: Under 35 U.S.C. 154(b), the term of this patent shall be extended for 0 days.

(21) Appl. No.: 09/586,052

(22) Filed: Jun. 2, 2000

(30) Foreign Application Priority Data

Jun. 3, 1999 (JP) ..... 11-156432

(51) Int. Cl.[7] ..... H01H 9/00

(52) U.S. Cl. ..... 200/1 R; 200/5 R; 200/293; 200/339

(58) Field of Search ..... 200/1 R, 5 R, 200/6 R, 12 R, 18, 293, 294, 295, 337, 553, 556

(56) References Cited

U.S. PATENT DOCUMENTS 5,414,231 5/1995 Sato et al. ..... 200/1 R
5,920,042 * 7/1999 Gotoh ..... 200/5 R
6,054,655 * 4/2000 Rudolph et al. ..... 200/16 R
6,097,105 * 8/2000 Oikawa ..... 307/10.1

* cited by examiner

*Primary Examiner*—Michael Friedhofer
(74) *Attorney, Agent, or Firm*—Brinks Hofer Gilson & Lione

(57) ABSTRACT

A switch device having an excellent external view, capable of maintaining stable operability of a finger grip portion over a long period of time by reducing a gap dimension between a panel and the finger grip portion (knob) of the switch device. The having a panel which has a concave portion provided with a pair of mutually-opposed inclined walls, the tip end sides of which are inclined so as to spread toward the outside, and a finger grip portion of the switch unit arranged within the concave portion, wherein the finger grip portion is constructed of an enclosure consisting of a top surface wall and side walls, wherein a pair of mutually-opposed side walls are inclined such that the distance therebetween becomes narrower toward the opening of the enclosure, and wherein the side walls run in parallel with the inclined wall of the panel.

2 Claims, 7 Drawing Sheets

SWITCH DEVICE CAPABLE OF MAINTAINING STABLE KNOB OPERABILITY OVER LONG TERM

BACKGROUND OF THE INVENTION

1. Technical Field of the Invention

The present invention relates to a switch device, and more particularly to a switch device used for opening or closing a window in an automobile-installed power window device.

2. Prior Art

With reference to the drawings, a description will be made of a conventional switch device.

FIG. 9 is an exploded perspective view showing a conventional switch device; FIG. 10 is a perspective view showing a conventional knob of the switch device; FIG. 11 is a sectional view taken on line 11—11 in FIG. 10; and FIG. 12 is s sectional view showing a conventional panel, a knob and a housing in the switch device.

As shown in FIGS. 9 to 12, the conventional switch device is schematically constructed of a panel 1; a plurality of (for example, two) knobs 20 to be housed in the panel 1; a housing 3 with which the panel 1 is engaged; a switch unit 4 which is housed in the housing 3 and to which the knobs 20 are mounted; a printed circuit board 5 to which the switchunit 4 is connected; and a cover 6 for housing the printed circuit board 5.

The panel 1 is made of synthetic resin material, is formed by fabrication, and has a substantially plane panel unit 1*a*; a side wall 1*b* which is orthogonal to the panel unit 1*a* from the back surface thereof and substantially surrounds the periphery of the panel unit 1*a*; and a plurality of (for example, two) concave portions 1*c*, each shaped to have a bottom, provided in a substantially central portion of the panel unit 1*a*. Also, the concave portion 1*c* has a pair of mutually opposed inclined walls 1*d*, a curved surface wall 1*e* provided between the pair of inclined walls 1*d*, and a substantially rectangular hole if. The bottom of the concave portion 1*c* is constituted by the curved surface wall 1*e*, and part of this bottom is provided with the hole if.

The pair of inclined walls 1*d* are inclined such that an interval therebetween becomes narrower away from the panel unit 1*a*. Also, this concave portion 1*c* on a side of the plane of the panel unit 1*a* of the panel 1 is open.

The knob 20 has a substantially box-like shape, made of synthetic resin material, formed by fabrication, and has a curved surface-shaped top surface wall 20*a*; a pair of first side walls 20*b* substantially orthogonal to the top surface wall 20*a*; a second side wall 20*c* provided between the pair of first side walls 20*b*, substantially orthogonal to the first side walls 20*b*; and an opening 20*d* on a side opposite to the top surface wall 20*a*. The periphery of the top surface wall 20*a* is subjected to so-called chamfering, and is formed into a curved surface shape. One end portion of the top surface wall 20*a* in the longitudinal direction protrudes outwardly to be formed as an operating unit 20*g*, while the other end portion extends to the opening 20*d*.

One surface (outer side) of the pair of first side walls 20*b* is inclined such that the interval becomes wider from the top surface wall 20*a* side toward the opening 20*d*, and the other surface (inside side) is provided to be substantially orthogonal to the top surface wall 20*a*. More specifically, the first side walls 20*b* are formed such that the thickness dimension thereof becomes thicker from the top surface wall 20*a* side toward the opening 20*d* for manufacturing reasons to be described later. A circular hole 20*f* is formed on the first side wall 20*b*.

In other words, this knob 20 is formed such that a width dimension to be formed between the pair of first side walls 20*b* becomes gradually larger from substantially the top surface wall 20*a* (socalled apex of knob 20) toward the opening 20*d*. Also, the knob 20 constitutes a so-called finger grip portion.

A housing 3 is made of synthetic resin material, is formed by fabrication, and has a substantially rectangular top wall 3*a*; a side wall 3*b* extending outwardly from the top wall 3*a* and surrounding the periphery; and a plurality of (for example, two) mounting units 3*c* provided at a substantially central portion of the top wall 3*a*.

The side wall 3*b* is provided with a plurality of (for example, six) rectangular convex portions 3*e* and a rectangular hole 3*f*.

The mounting unit 3*c* has a rectangular hole 3*d*, wall portions 3*g* provided all around the hole 3*d*, and a pair of cylindrical column-shaped convex portions 3*h* provided to oppose to the mutually-opposed wall portions 3*g*. This housing 3 is housed into the panel 1 from the side of the opened plane of the panel 1, and is arranged by appropriate means such as snap-in. At this time, the mounting unit 3*c* of the housing 3 is housed and arranged within the concave portion 1*c* of the panel 1.

The knob 20 is inserted into the concave portion 1*c*, and the pair of convex portions 3*h* of the mounting unit 3*c* are inserted into the circular hole 20*f* in the first side wall 20*b* of the knob 20, whereby the knob 20 is arranged to enable it to rock with respect to the housing 3.

In this state, the pair of inclined walls 1*d* of the concave portion 1*c* in the panel 1 and the pair of first side walls 20*b* of the knob 20 are assembled to oppose to each other so as to have different directions of inclination. Therefore, a gap dimension 12 (See FIG. 12) between the inclined wall 1*d* and the first side wall 20*b* on the panel unit 1*a* side is set to a comparatively large value, and a gap dimension 13 of the concave portion 1*c* on the bottom side is set to a comparatively small value (12>13).

That is, the gap dimension between the inclined wall 1*d* and the first side wall 20*b* is set so as to become gradually larger from the bottom side of the concave portion 1*c* toward the panel unit 1*a* side.

Next, a description will be made of a forming mold for manufacturing a conventional knob for the switch device. FIG. 13 is a sectional view showing a forming mold for manufacturing the knob for the switch device. As shown in FIG. 13, this forming mold is schematically constructed of: a first mold 41 as a stationary mold; a second mold 42 to be inserted into the first mold 41, as a movable mold; and a third mold 43, as a slide core, to be mounted to the first mold 41, and to be slid so as to sandwich the second mold 42 therebetween.

The first mold 41 has a concave portion 41*a* which is substantially U-shaped in cross section, and whose angular portions have been chamfered. In this concave portion 41*a*, mutually-opposed sides in the concave portion 41*a* are inclined such that they are slightly opened toward an open end side. The mutually-opposed inclined sides within the concave portion 41*a* are provided in order to reliably and easily release on releasing a knob to be fabricated by this forming mold from the forming mold.

The second mold 42 is shaped like an inverted, substantially T-character in cross section, and has a base 42*a* and a convex portion 42*b* protruding outward (upward) from the substantially central portion of one surface (upper surface) of the base 42*a*. The structure is arranged such that the tip end portion of the convex portion 42*b* is arranged to oppose within the concave portion 41*a* of the first mold 41 and that the convex portion 42*b* goes in and out of the concave portion 41*a*. When the end surface of the first mold 41 has abutted upon the base 42*a* of the second mold 42, substantially U-shaped space is formed between the concave portion 41*a* and the convex portion 42*b*.

A third mold 43 is substantially T-shaped in cross section, and has a pair of bases 43*a*, which slide, and a pair of cylindrical column-shaped convex portions 43*b*, each protruding outward from one side of the base 43*a*. The tip end portion of the convex portion 43*b* abuts upon the side of the convex portion 42*b* of the second mold 42, and the convex portion 43*b* is used to form the circular hole 20*f* in the first side wall 20*b*.

More specifically, this third mold 43 slides as if it sandwiched the second mold 42, and slides until the cylindrical column-shaped convex portion 43*b* abuts upon the second mold 42.

A parting line (PL) of the knob 20 obtained by fabricating using a forming mold having a structure described above is provided near the opening 20*d* in the first side wall 20*b*.

Next, a description will be made of a forming mold for fabricating the panel 1 in the switch device although not shown. The pair of inclined walls id for constituting the concave portion 1*c* in the panel 1 are formed using a forming mold having an inclined surface, and the inclined surface of the mold is required to reliably and easily release from the mold on releasing a panel 1 to be obtained by fabrication, from the forming mold.

In the conventional switch device, however, the pair of inclined walls 1*d* in the concave portion 1*c* of the panel 1 and the pair of first side walls 20*b* of the knob 20 are arranged to oppose to each other, and the respective angles of inclination become different in direction when assembled, and the gap dimension therebetween becomes a comparatively large dimension.

Consequently, a gap dimension 12 with the top surface wall 20*a* of the knob 20 on the side of the panel unit 1*a* of the panel 1 becomes large, and therefore, there is the problem that when foreign matter such as dust enters this gap, the operability of the knob 20 will be deteriorated.

Also, when the gap dimension is comparatively large, there is the problem that this gap becomes undesirable also in view of a fine appearance.

SUMMARY OF THE INVENTION

The present invention has been achieved in order to solve the above-described problems, and is aimed to provide a switch device presenting a fine appearance, capable of maintaining stable knob operability over a long term by reducing a gap dimension between the panel and the knob in the switch device.

A switch device according to the present invention has a panel having a concave portion provided with a pair of mutually-opposed inclined walls, the tip end sides of which are inclined so as to spread toward the outside, and a finger grip portion of the switch unit arranged within the concave portion, wherein the finger grip portion is constructed of an enclosure consisting of a top surface wall and side walls, wherein the pair of mutually-opposed side walls are inclined such that the tip end side becomes narrower toward the side of an opening of the enclosure, and wherein the finger grip portion is housed in the concave portion such that the side walls and the inclined walls run in parallel.

Also, a switch device according to the present invention is constructed such that the side wall of the finger grip portion is provided with a concave portion surrounded by edge portions.

DETAILED DESCRIPTION OF THE PREFERRED EMBODIMENT

Embodiment of the Invention

With reference to the drawings, the description will be made of a switch device according to an embodiment of the present invention.

Figure 1:
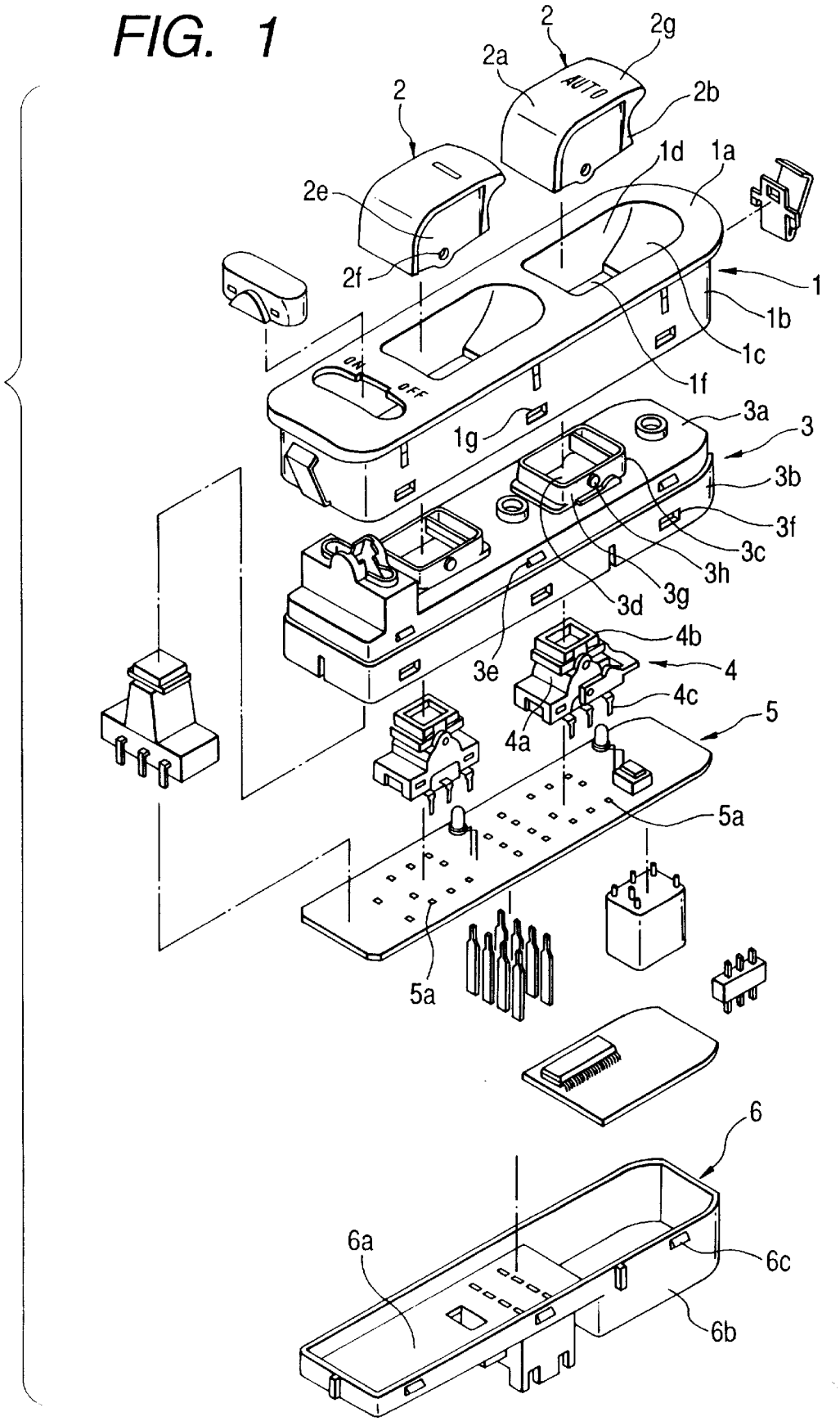
FIG. 1 is an exploded perspective view showing a switch device according to an embodiment of the present invention.
Figure 2:
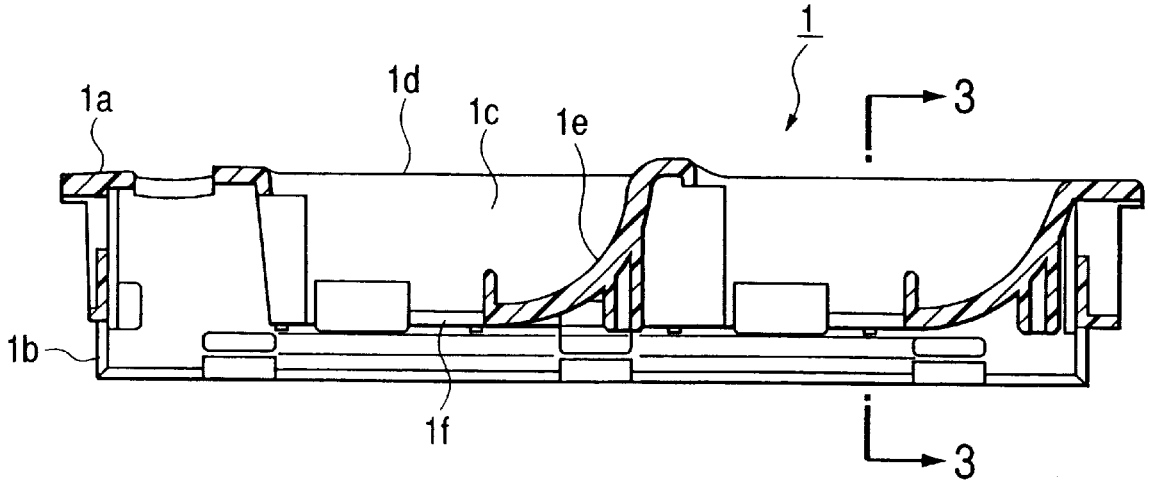
FIG. 2 is a sectional view showing a panel of the switch device according to the embodiment of the present invention.
Figure 3:
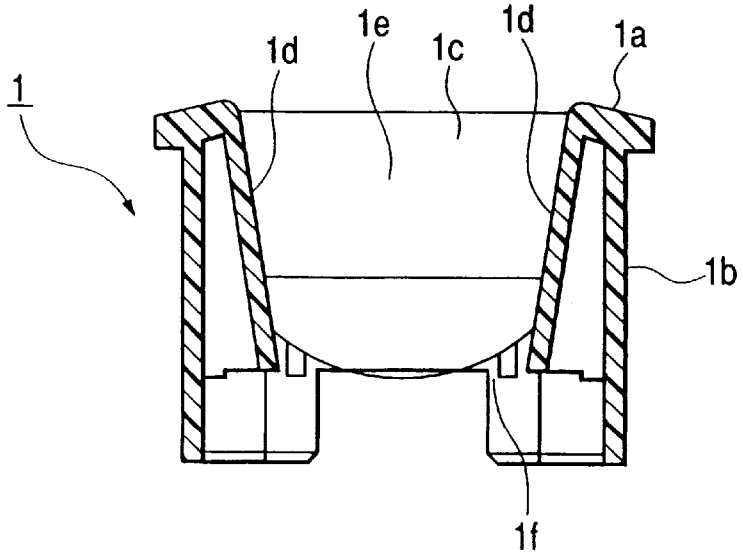
FIG. 3 is a sectional view taken on line 3—3 of FIG. 2.
Figure 4:
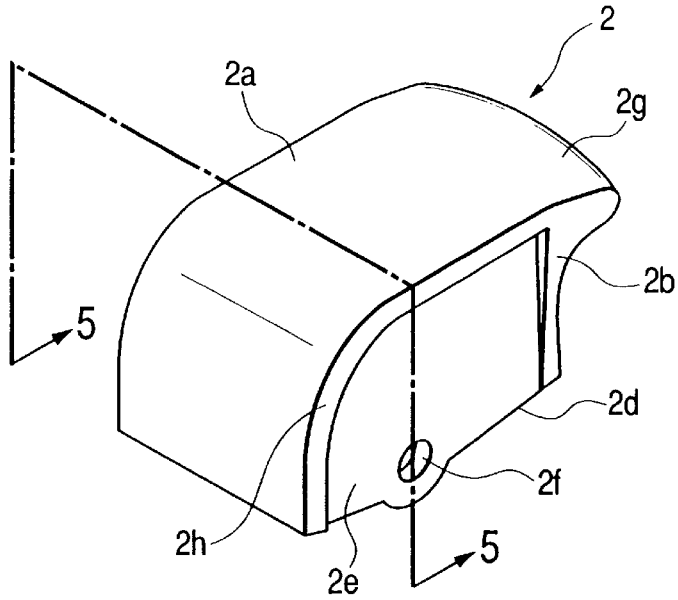
FIG. 4 is a perspective view showing a knob of the switch device according to the embodiment of the present invention.
Figure 5:
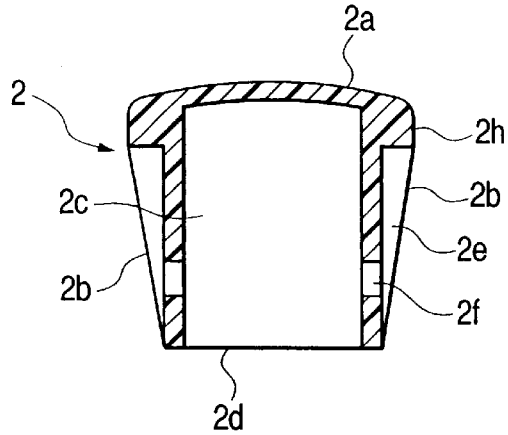
FIG. 5 is a sectional view taken on line 5—5 of FIG. 4.
Figure 6:
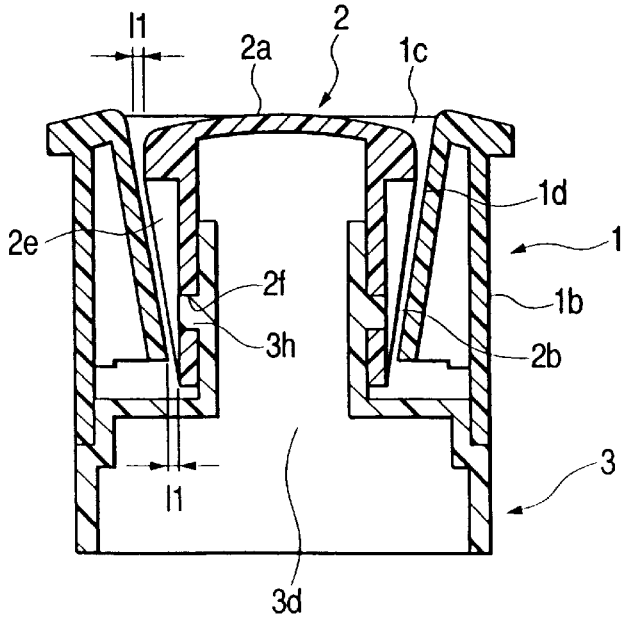
FIG. 6 is a sectional view showing a panel, a knob and a housing of the switch device according to the embodiment of the present invention.

FIG. 1 is an exploded perspective view showing a switch device according to an embodiment of the present invention; FIG. 2 is a sectional view showing a panel of the switch device according to the present invention; FIG. 3 is a sectional view taken on line 3—3 of FIG. 2; FIG. 4 is a perspective view showing a knob of the switch device according to the present invention; FIG. 5 is a sectional view taken on line 5—5 of FIG. 4; and FIG. 6 is a sectional view showing a panel, a knob and a housing of the switch device according to the present invention.

In this respect, portions identical to those in the conventional switch device are designated by the identical reference numerals.

As shown in FIGS. 1 to 6, a switch device according to the present invention is schematically constructed of a panel 1; a plurality of (for example, two) knobs 2 to be housed in the panel 1; a housing 3 with which the panel 1 is engaged; a switch unit 4 to be housed in the housing 3, to which the knobs 2 are mounted; a printed circuit board 5, to which the switch unit 4 is connected; and a cover 6, which houses the printed circuit board 5 and engages with the housing 3.

The panel 1 is made of synthetic resin material, is formed by fabrication, and has a substantially plane panel unit 1*a*; a side wall 1*b* which is orthogonal to the panel unit 1*a* from the back surface thereof and substantially surrounds the periphery of the panel unit 1*a*; and a plurality of (for example, two) concave portions 1*c* shaped to have a bottom provided in the substantially central portion of the panel unit 1*a*. Also, the concave portion 1*c* has a pair of mutually-opposed inclined walls 1*d*; a curved surface wall 1*e* provided between the pair of inclined walls 1*d*; and a substantially rectangular hole 1*f*. A bottom of the concave portion 1*c* is constituted by the curved surface wall 1*e*, and part of this bottom is provided with the hole 1*f*.

The pair of inclined walls 1*d* are inclined such that an interval therebetween becomes narrower away from the panel unit 1*a*. In other words, the pair of inclined walls 1*d* are inclined such that the tip end side of the concave portion 1*c* spreads toward the outside thereof. Also, this concave portion 1*c* on a side of the plane of the panel unit 1*a* of the panel 1 is open.

The knob 2 has a substantially box-like shape, made of synthetic resin material, formed by fabrication, and has a curved surface-like top surface wall 2*a*; a pair of first side walls 2*b* substantially orthogonal to the top surface wall 2*a*; a second side wall 2*c* provided between the pair of first side walls 2*b*, substantially orthogonal to the first side walls 2*b*; and an opening 2*d* on a side opposite to the top surface wall 2*a*, constituting a so-called enclosure. Also, the periphery of the top surface wall 2*a* is subjected to so-called chamfering, and is formed into a curved-surface shape. One end portion of the top surface wall 2*a* in the longitudinal direction protrudes outwardly, and is formed as an operating unit 2*g*, and the other end portion is extended to an opening 2*d*.

One surface (outer side) of the pair of first side walls 2*b* is inclined such that the interval becomes narrower from the top surface wall 2*a* side toward the opening 2*d*, and on this one surface, there is provided a concave portion 2*e* leaving an inclined edge portion 2*h* in the periphery, and the other surface (inner side) is provided to be substantially orthogonal to the top surface wall 2*a*. More specifically, the first side wall 2*b* is formed such that the thickness dimension thereof becomes thinner from the top surface wall 2*a* side toward the opening 2*d*. A circular hole 2*f* is formed on the first side wall 2*b*. Because of the concave portion 2*e*, the first side wall 2*b* in this concave portion 2*e* portion has substantially uniform dimension in thickness dimension. Also, the concave portion 2*e* surrounded by the edge portion 2*h* constitutes a lightening portion for improving the dimensional accuracy and so-called weight-saving.

In other words, this knob 2 is formed such that a width dimension to be formed by edge portions 2*h* of the pair of first side walls 2*b* gradually becomes narrower toward the opening 2*d* except the top surfacewall 2*a* (so-called tapex of knob 2) portion. This knob 2 constitutes a so-called finger grip portion.

A housing 3 is made of synthetic resin material, is formed by fabrication, and has a substantially rectangular top wall 3*a*; a side wall 3*b* extending outwardly from the top wall 3*a* and surrounding the periphery; and a plurality of (for example, two) mounting units 3*c* provided at the substantially central portion of the top wall 3*a*.

Also, the side wall 3*b* is provided with a plurality of (for example, six) rectangular convex portions 3*e* and a rectangular hole 3*f*.

The mounting unit 3*c* has a rectangular hole 3*d*, wall portions 3*g* provided all around the hole 3*d*, and a pair of cylindrical column-shaped convex portions 3*h* provided to oppose to the mutually-opposed wall portions 3*g*. This housing 3 is housed into the panel 1 from the side of the opened plane of the panel 1, and a convex portion 3*e* of the housing 3 is snapped in a hole 1*g* provided in the side wall 1*b* of the panel 1 so that the housing 3 and the panel 1 are integrally arranged. At this time, the mounting unit 3*c* of the housing 3 is housed and arranged within the concave portion 1*c* of the panel 1.

The knob 2 is inserted into the concave portion 1*c*, and a pair of convex portions 3*h* of the mounting unit 3*c* are inserted into the circular hole 2*f* in the first side wall 2*b* of the knob 2, whereby the knob 2 is arranged to enable it to rock with respect to the housing 3.

In this state, the pair of inclined walls 1*d* within the concave portion 1*c* of the panel 1, and the pair of first side walls 2*b* of the knob 2 are assembled to opposite to each other with with the directions of inclination set to the same one. Therefore, the formation is made such that a gap dimension 11 between the inclined wall 1*d* and the fist side wall 2*b* is a smaller dimension value than the conventional one, and is the substantially uniform (same) dimension value over the entire surface. In other words, the knob 2 (finger grip portion) is housed within the concave portion 1*c* such that the first side wall 2*b* runs parallel to the inclined wall 1*d*.

A switch unit 4 has a case 4*a* made of insulating synthetic resin material such as, for example, glass-filled epoxy, and formed into a substantially box-like shape by fabrication; stationary contacts (not shown) and movable contacts (not shown) housed within the case 4*a*; an operating member 4*b* supported on the top surface side of the case 4*a*, for rocking; and a plurality of (for example, six) L-shaped switch terminals 4*c*, connected to the stationary contacts (not shown). Also, the structure is arranged such that the operating member 4*b* is restrained by the knob 2 by appropriate means and rocking of the knob 2 causes the operating member 4*b* to rock, and as a result, the movable contacts are brought into and out of contact with the stationary contacts to thereby turn on/off the switch unit 4.

An ON/OFF operation of the switch unit 4 causes a window in an automobile-mounted power window device to be opened or closed.

A printed circuit substrate 5 is made of insulating synthetic resin material such as glass-filled epoxy, is formed like a flat plate, and a wiring pattern (not shown) having a predetermined shape is provided at least on a side (for example, back side) of one surface. Also, the printed circuit board 5 has a plurality of (for example, 6×2=12) switch terminal holes 5*a*, and switch terminals 4*c* of the switch unit 4 are inserted into these switch terminal holes 5*a* and tip end portions of the switch terminals 4*c* are soldered to the wiring pattern (not shown).

The printed circuit board 5 to which the switch unit 4 is connected is housed and arranged within the housing 3 by appropriate means. In this state, the knob 2 is housed and arranged within the concave portion 1*c* of the panel 1.

A cover 6 is made of synthetic resin material, is formed into a substantially box-like shape by fabrication, and has a bottom wall 6*a*; a side wall 6*b* vertically provided all around the bottom wall 6*a*; and a plurality of convex portions 6*c*. In this cover 6, there is housed the printed circuit board 5, and a convex portion 6*c* of the cover 6 is snapped in a hole 3*f* in the housing 3 so that the cover 6 is engaged with the housing 3.

Next, a description will be made of a forming mold for manufacturing a panel and a knob in the switch device according to the present invention.

First, a description will be made of a forming mold for manufacturing the panel in the switch device.

Figure 7:
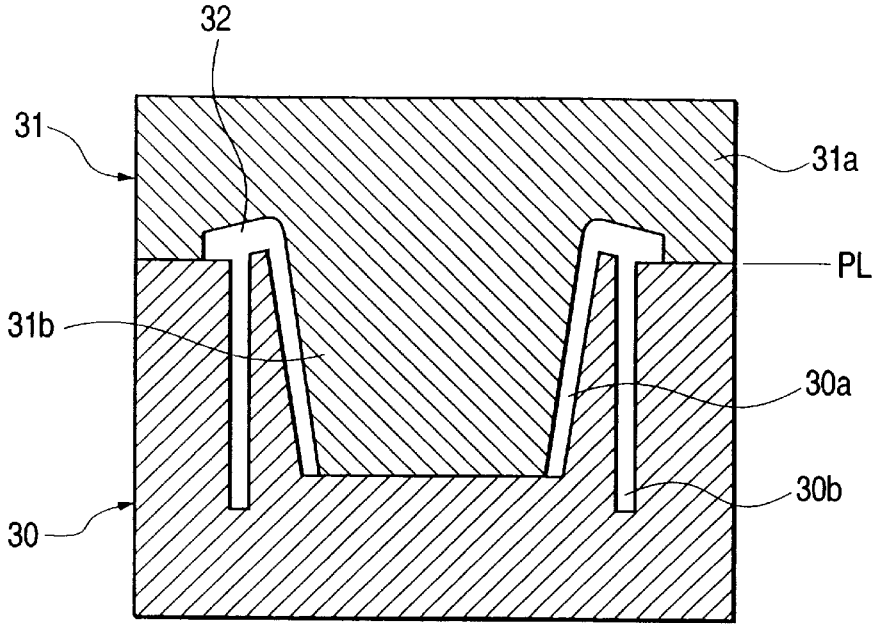
FIG. 7 is a sectional view showing a forming mold for manufacturing the panel of the switch device according to the present invention.

FIG. 7 is a sectional view showing a forming mold for manufacturing the panel in the switch device. As shown in FIG. 7, this forming mold is schematically constructed of a first mold 30 as a stationary mold, and a second mold 31 as a movable mold to be inserted into the first mold 30.

The first mold 30 is substantially U-shaped in cross section, and has a concave portion 30*a* having inclined surf aces for forming the pair of inclined walls 1*d* of the panel 1, and grooved portions 30*b* for forming the side wall 1*b*.

The second mold 31 is substantially T-shaped in cross section, and has a base 31*a* for forming the panel unit 1*a* of the panel 1; and a convex portion 31*b* for protruding outwardly from one surface (bottom surface) of the base 31*a* to form the concave portion 1*c* of the panel 1. The top surface of the first mold 30 abuts upon the bottom surface of the second mold 31, and the convex portion 31*b* of the second mold 31 is inserted into the concave portion 30*a* of the first mold 30 and is arranged.

In this state, space 32 which becomes a shape of the panel 1 is formed between the first mold 30 and the second mold 31, and the synthetic resin material, which has been heated into a fluid state, is poured into the space 32 while being pressurized to fabricate the panel 1.

Also, the concave portions 30*a* in the first molds 30 have the inclined surfaces because on releasing the panel 3 thus obtained by fabrication from the forming mold, they are required to reliably and easily release from the mold.

Next, a description will be made of a forming mold for manufacturing a knob in the switch device.

Figure 8:
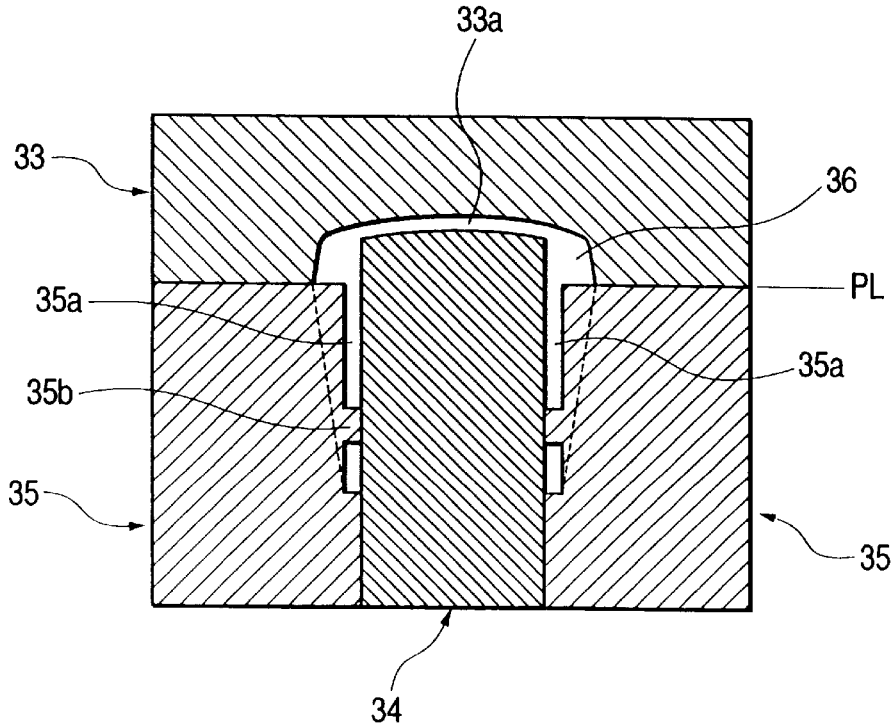
FIG. 8 is a sectional view showing a forming mold for manufacturing the knob of the switch device according to the present invention.
Figure 9:
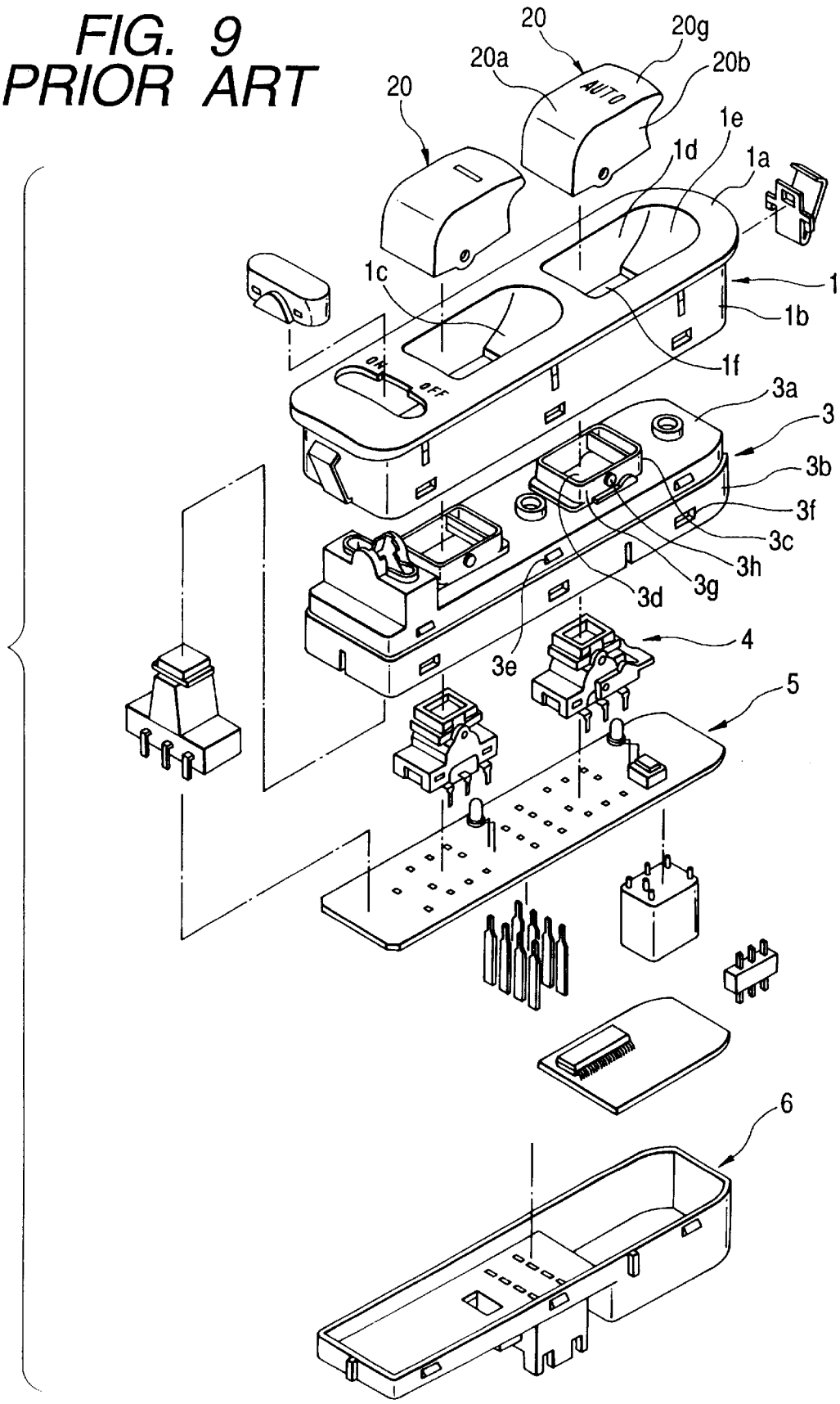
FIG. 9 PRIOR ART
FIG. 9 is an exploded perspective view showing a conventional switch device.
Figure 10:
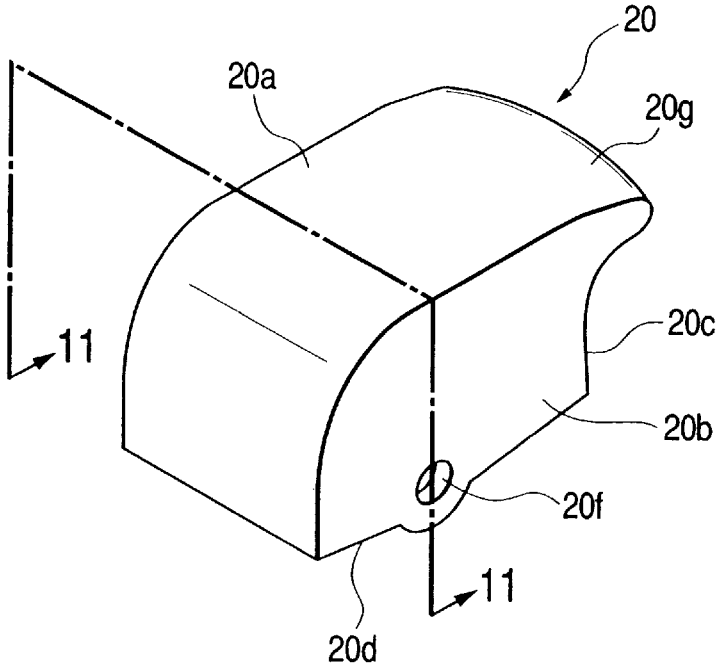
FIG. 10 PRIOR ART
FIG. 10 is a perspective view showing a conventional knob of the switch device.
Figure 11:
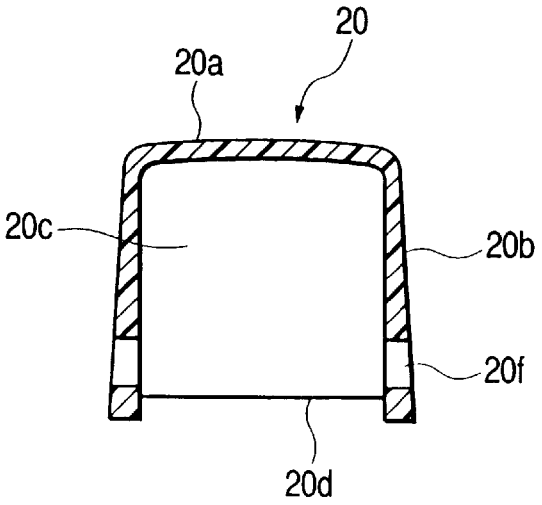
FIG. 11 PRIOR ART
FIG. 11 is a sectional view taken on line 11—11 of FIG. 10.
Figure 12:
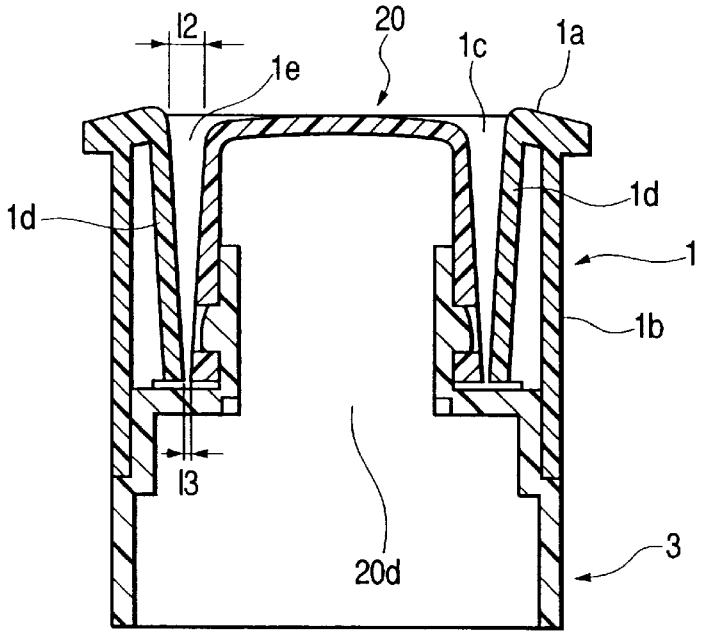
FIG. 12 PRIOR ART
FIG. 12 is a sectional view showing a conventional panel, a knob and a housing of the switch device.
Figure 13:
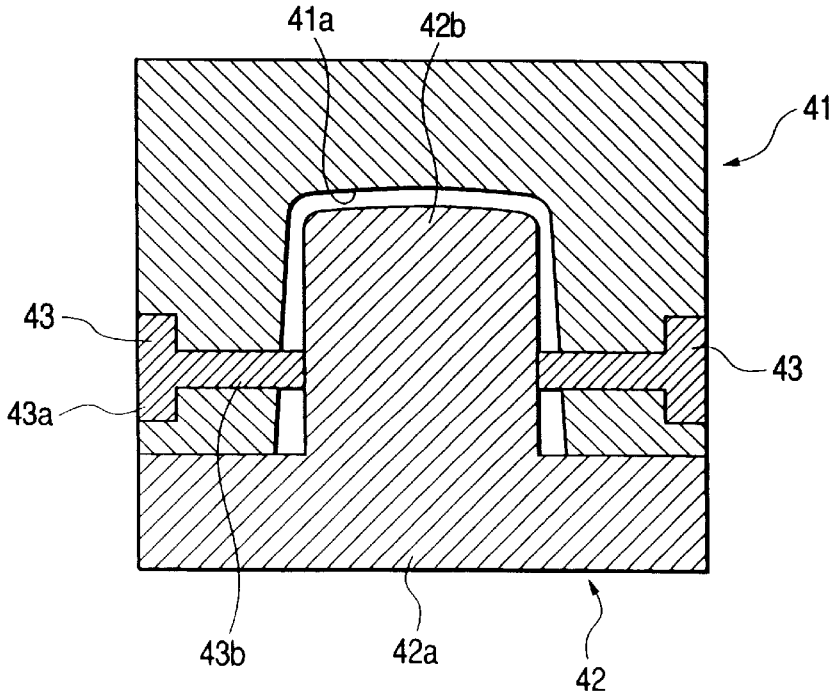
FIG. 13 PRIOR ART
FIG. 13 is a sectional view showing a forming mold for manufacturing the conventional knob of the switch device.

FIG. 8 is a sectional view showing a forming mold for manufacturing a knob in the switch device. As shown in FIG. 8, this forming mold is schematically constructed of a third mold 33 as a stationary mold; a fourth mold 34 as a movable mold to be inserted into the third mold 33; and a fifth mold 35 as a slide core.

The third mold 33 is substantially U-shaped in cross section, and has a concave portion 33*a*, whose angular portions have been chamfered. This concave portion 33*a* is used to form the top surface wall 2*a* of the knob 2, and has an inclined surface which is opened toward the open end portion side of the concave portion 33*a*.

The fourth mold 34 is substantially shaped like a rectangle in cross section, and is used to form the space and the opening 2*d* of the substantially box-shaped knob 2.

The fifth mold 35 is substantially shaped like a rectangle in cross section, a concave portion 35*a* is provided on one side (inner side), and there is provided a cylindrical column-shaped convex portion 35*b* in a substantially central portion of this concave portion 35*a*. As regards this fifth mold 35, a pair of fifth molds 35 are bilaterally symmetrically arranged. These fifth molds 35 slide respectively so as to sandwich the fourth mold 34 therebetween, and slide until the cylindrical column-shaped convex portion 35*b* abuts upon the fourth mold 34. Also, at this time, the tip end portions (apexes) of the fifth molds 35 abut upon the third mold 33.

The third mold 33 and the fourth mold 34 are opposed to each other with space for forming the top surface wall 2*a* interposed therebetween, and the pair of fifth molds 35 are arranged so as to sandwich the fourth mold 34 therebetween. At this time, between the fourth mold 34 and the fifth molds 35, there is formed space for forming the pair of first side walls 2*b*.

In this state, space 36, which forms the shape of the knob 2, is formed by means of the third mold 33, the fourth mold 34 and the fifth molds 35, and the synthetic resin material, which has been heated into a fluid state, is poured into the space 36 while being pressurized to fabricate the knob 2. At this time, a so-called parting line (PL) is to be formed in portions where the third mold 33 abuts upon the fifth molds 35. That is, the parting line (PL) is provided near the top surface wall 2*a*.

Also, the concave portion 33*a* in the third mold 33 has an inclined surface which is opened toward the open end portion side of the concave portion 33*a* because on releasing the knob 2 obtained by fabrication from the forming mold, the releasing is reliably and easily performed.

Effect of the Invention

As described above, a switch device according to the present invention is capable of maintaining stable operability of the finger grip portion (knob) over a long period of time because the finger grip portion is housed within the concave portion of the panel such that the side wall of the finger grip portion runs parallel to the inclined wall of the panel, whereby a gap dimension in the concave portion between the side wall and the inclined wall on the opening side can be formed narrow, and therefore, there is no possibility that any foreign matter such as dust enters this gap.

Also, since the gap dimension is a comparatively small dimension, this narrow gap provides a switch device desirable also in view of a fine appearance.

Also, a switch device according to the present invention is provided with a concave portion surrounded by edge portions on the side wall of the finger grip portion (knob), and since the weight can be saved by the volume of this concave portion, this switch device can be reduced in weight, and further, the material cost for the amount can be saved, thus making it possible to provide a low-cost switch device.

In addition, as described above, the edge portion of the side wall of the finger grip portion and the inclined wall of the panel slantingly run in parallel, and the gap dimension is a comparatively narrow dimension, and therefore, this narrow gap provides a switch device desirable also in view of a fine appearance.

What is claimed is:

1. A switch device, comprising: a panel having a concave portion provided with a pair of mutually-opposed inclined walls, tip end sides of the pair of mutually-opposed inclined walls are inclined to spread toward outside; and a finger grip portion arranged within the concave portion, wherein the finger grip portion is constructed of an enclosure consisting of a top surface wall and side walls, wherein a pair of mutually-opposed one of the side walls are inclined such that tip end sides of the side walls become narrower toward a side of an opening of the enclosure, and wherein the finger grip portion is housed in the concave portion such that the side walls and the inclined walls run in parallel.

2. A switch device according to claim 1, wherein each of the pair of side walls of the finger grip portion are provided with a concave portion surrounded by edge portions.

* * * * *

UNITED STATES PATENT AND TRADEMARK OFFICE

CERTIFICATE OF CORRECTION

PATENT NO. : 6,191,372 B1
DATED : February 20, 2001
INVENTOR(S) : Mikio Sasaki et al.

It is certified that error appears in the above-identified patent and that said Letters Patent is hereby corrected as shown below:

Title page,
Foreign Application Prioriry Data, delete "11-156432" and substitute -- 11-156435 -- in its place.

Column 8,
Line 55, delete "one" and substitute -- ones -- in its place.

Signed and Sealed this

Fourteenth Day of May, 2002

*Attest:*

*Attesting Officer*

JAMES E. ROGAN
*Director of the United States Patent and Trademark Office*